United States Patent [19]

Berendt et al.

[11] Patent Number: 4,604,099

[45] Date of Patent: Aug. 5, 1986

[54] PROCESS FOR PRINTING CELLULOSE-CONTAINING TEXTILE MATERIAL WITH FOAM-CONTAINING REACTIVE DYES AND ADDITION OF (METH) ACRYLAMIDE POLYMERS

[75] Inventors: Hans-Ulrich Berendt, Allschwil; Paul Schäfer, Riehen, both of Switzerland

[73] Assignee: Ciba-Geigy Corporation, Ardsley, N.Y.

[21] Appl. No.: 694,189

[22] Filed: Jan. 23, 1985

[30] Foreign Application Priority Data

Jan. 30, 1984 [CH] Switzerland ..... 415/84
May 18, 1984 [CH] Switzerland ..... 2457/84

[51] Int. Cl.[4] ..... D06P 1/52; D06P 3/66

[52] U.S. Cl. ..... 8/477; 8/543; 8/555; 8/918

[58] Field of Search ..... 8/477, 543, 555

[56] References Cited

U.S. PATENT DOCUMENTS 3,546,321 12/1970 Jabloner et al. ..... 525/398
4,394,493 7/1983 Bartkovitz et al. ..... 525/530
4,397,650 8/1983 Gregorian ..... 8/477

FOREIGN PATENT DOCUMENTS 0075955 6/1983 European Pat. Off. .
3202548 8/1983 Fed. Rep. of Germany .

*Primary Examiner*—A. Lionel Clingman
*Attorney, Agent, or Firm*—Edward McC. Roberts; Kevin T. Mansfield; Meredith C. Findlay

[57] ABSTRACT

Textile cellulose material is printed with a reactive dye by applying to the cellulose material a foamed aqueous preparation which, in addition to the dye, contains foaming agent and a homopolymer or copolymer of acrylamide or methacrylamide or preferably a graft polymer obtained from an adduct of an alkylene oxide, preferably propylene oxide, on an at least trihydric aliphatic alcohol, for example glycerol, and acrylamide or methacrylamide.

The printed cellulose material is then subjected to a heat treatment, for example steaming, to fix the dye.

This foamed printing color produces without the use of thickenings a deep, level and crisp print which also has excellent handle.

23 Claims, No Drawings

PROCESS FOR PRINTING CELLULOSE-CONTAINING TEXTILE MATERIAL WITH FOAM-CONTAINING REACTIVE DYES AND ADDITION OF (METH) ACRYLAMIDE POLYMERS

The present invention relates to a process for printing cellulose-containing textile material with reactive dyes by means of foam printing colours.

It is known that cellulose fibre materials can be coloured by means of foamed printing colour compositions, using as colouring components pigments or pigment preparations which are always combined with binders. These binder-containing compositions have the disadvantage that they impair the handle of the material.

In contrast, no binder is generally used in printing with reactive dyes. For that reason the print has no effect on the handle. However, obtaining good crispness with reactive dyes requires large amounts of thickener. The disadvantage of using thickeners is that they need to be specially washed off after the dye has been printed on and fixed. This additional wash requires appreciable hardware and increases the consumption of energy, water and various chemicals.

It has now been found that it is possible to obtain the desired crispness without using thickeners if cellulose-containing textile material is printed using the method set forth hereinafter.

The present invention accordingly provides a process for printing cellulose-containing textile material with reactive dyes by printing the textile material with a foamed aqueous preparation and fixing the dyes through the action of heat, said preparation containing dyes and foaming agents in the absence or presence of further assistants, for example fixing alkalis, wherein the preparation additionally contains a homopolymer or copolymer of acrylamide or methacrylamide or a graft polymer which is obtainable from an adduct of an alkylene oxide on an at least trihydric aliphatic alcohol having 3 to 10 carbon atoms and acrylamide or methacrylamide. This preparation can also contain mixtures of said polymers.

The amounts in which the required acrylamide polymers are added alone or mixed to the preparations to be foamed can vary with the printing method between 0.5 and 20 g/l in the form of aqueous solutions. Thus, amounts of 0.5 to 20 g, advantageously 0.5 to 10 g, preferably 1 to 5 g in the form of 2 to 10% aqueous solutions per litre of unfoamed printing colour have been found to be advantageous.

The acrylamide- or methacrylamide-based polymers used according to the invention are preferably the graft polymers of the type defined.

Preferred graft polymers can be obtained by graft-polymerising methacrylamide or in particular acrylamide onto an adduct of 4 to 100 moles, preferably 40 to 80 moles, of propylene oxide on trihydric to hexahydric alkanols having 3 to 6 carbon atoms. These alkanols can be straight-chain or branched. Examples thereof are glycerol, trimethylolethane, trimethylolpropane, erythritol, pentaerythritol, mannitol and sorbitol.

Also suitable are graft polymers prepared by grafting methacrylamide or acrylamide onto adducts of mixtures of ethylene oxide and propylene oxide or of ethylene oxide alone on said polyhydric alcohols.

In particular, graft polymers of acrylamide and adducts of 40 to 80 moles of propylene oxide on 1 mole of glycerol have been found to be particularly suitable.

The graft polymers used according to the invention advantageously contain 2.5 to 50% by weight of the defined adduct as parent chain and 50 to 97.5% by weight of grafted-on methacrylamide or preferably acrylamide as side chains.

The graft polymers preferably contain 2.5 to 30% by weight of the alkylene oxide adduct of the type as defined and 70 to 97.5% by weight of grafted-on methacrylamide or in particular acrylamide. Still more preferable is an amide content of 80 to 97.5% by weight, based on the graft polymer.

Of these products, those which contain as the parent chain 4 to 20% by weight of the adduct of 40 to 80 moles of propylene oxide on 1 mole of glycerol and 80 to 96% by weight of acrylamide are especially preferred.

The specified percentages are based on the graft polymer as a whole.

The graft polymers used according to the invention are prepared by methods known per se, advantageously by polymerising (1) an adduct of alkylene oxide on an at least trihydric aliphatic alcohol of 3 to 10 carbon atoms with (2) acrylamide or methacrylamide in the presence of catalysts, advantageously at a temperature of 40° to 100° C. The products are thus predominantly graft polymers in which the alkylene oxide adduct forms the parent chain which, on individual carbon atoms, contains the grafted-on acrylamide or methacrylamide in the form of side chains.

The catalysts used are advantageously free-radical forming organic or preferably inorganic initiators. Examples of suitable organic initiators for carrying out the free-radical polymerisation are symmetrical peroxodicarbonates, butyl peroctoates, butyl perbenzoates, peracetates and peroxodicarbamates. Suitable inorganic initiators are hydrogen peroxide, perborates, persulfates and peroxodisulfates.

The preferred initiator or activator is potassium peroxodisulfate.

These catalysts can be used in amounts of 0.05 to 5 percent by weight, advantageously 0.05 to 2 percent by weight and preferably 0.1 to 1 percent by weight, based on the starting materials.

The graft polymerisation is advantageously carried out in an inert atmosphere, for example in a nitrogen atmosphere.

The graft polymers are obtained in the form of a very viscous mass. By dissolving and diluting with water it is possible to prepare gellike products having a solids content of, for example, 0.5 to 20% by weight, preferably 2 to 20% by weight. To preserve and/or improve the shelf life of the aqueous graft polymer solutions obtained it is possible to add preservatives, for example chloroacetamide, N-hydroxymethylchloroacetamide, pentachlorophenolates, alkali metal nitrites, triethanolamine or preferably hydroquinone monomethyl ether or even antibacterial agents, for example sodium azide, or surface-active quaternary ammonium compounds which contain one or two fatty alkyl radicals. It is also advantageously possible to add mixtures of these preservatives and germicidal compounds.

The particularly preferred 2 to 5% solutions of the graft polymers obtained have a viscosity at 25° C. of 3,000 to 150,000, preferably 15,000 to 120,000, and in particular 40,000 to 80,000 mPas (millipascalsecond).

The polyalkylene oxide adducts used in preparing the graft polymers generally have a molecular weight of 400 to 6,000, preferably 3,000 to 4,500.

In place of said graft polymers, it is also possible to use in the foam-printing linear or branched polymers of acrylamide or methacrylamide and copolymers of acrylamide or methacrylamide and further ethylenically unsaturated monomers, for example acrylic acid, methacrylic acid, α-halogenoacrylic acid, 2-hydroxyethylacrylic acid, α-cyanoacrylic acid, crotonic acid, vinylacetic acid, maleic acid, acrylonitrile, methacrylonitrile, vinyl alkyl ethers (methyl vinyl ether, isopropyl vinyl ether), vinyl esters (vinyl acetate), styrene, vinyltoluene, vinylsulfonic acid, 2-acrylamido-2-methylpropanesulfonic acid or esters of said α,βunsaturated carboxylic acids and especially half-esters of maleic acid with adducts of 2 to 15 moles of ethylene oxide on monoalcohols having 8 to 22 carbon atoms. The weight ratio of acrylamide to the other monomers is preferably between 9:1 and 1:1.

A suitable foaming agent is generally an anionic or nonionic compound having surface-active properties, hereinafter referred to as a surfactant. Surfactants reduce the surface tension of solutions and thereby facilitate foaming and stabilise the foam. Both anionic and nonionic surfactants can be present as individual compounds, as mixtures within type or as combinations of anionic and nonionic surfactants.

Examples of suitable anionic surfactants are:

sulfated aliphatic alcohols whose alkyl chain has 8 to 18 carbon atoms, for example sulfated lauryl alcohol;

sulfated unsaturated fatty acid or lower alkyl esters thereof which have 8 to 20 carbon atoms in the fatty radical, for example ricinoleic acids and oils containing such fatty acids, for example castor oil;

alkylsulfonates whose alkyl chain contains 8 to 20 carbon atoms, for example dodecylsulfonate or pentadecylsulfonate;

alkylarylsulfonates having 1 or 2 straight-chain or branched alkyl chains having a total of at least 6 carbon atoms, for example dodecylbenzenesulfonates, dibutylnaphthalenesulfonates or 3,7-diisobutylnaphthalenesulfonates;

sulfonated 1-benzyl-2-alkylbenzimidazoles having 8 to 22 carbon atoms in the alkyl radical;

sulfonates of polycarboxylic acid esters, for example dioctyl sulfosuccinates or sulfosuccinamides;

the alkali metal, ammonium or amine salts, referred to as soaps, of fatty acids having 10 to 20 carbon atoms, for example colophony salts;

esters of polyalcohols, in particular monoglycerides or diglycerides of fatty acids having 12 to 18 carbon atoms, for example monoglycerides of lauric, stearic or oleic acid, and the acid esters—obtained within an organic dicarboxylic acid, for example maleic acid, malonic acid or sulfosuccinic acid, but preferably with an inorganic polybasic acid, for example o-phosphoric acid or in particular sulfuric acid—of adducts of 1 to 60, preferably 2 to 30, moles of ethylene oxide and/or propylene oxide on fatty amines, fatty amides, fatty acids or fatty alcohols having 8 to 22 carbon atoms each, on alkylphenols having 4 to 16 carbon atoms in the alkyl chain, o-phenylphenol, benzylphenol or on trihydric to hexahydric alkanols having 3 to 6 carbon atoms.

The acid radical of these anionic surfactants is generally in the salt form, i.e. for example in the form of alkali metal, ammonium or amine salt. Examples of these salts are lithium, sodium, potassium, ammonium, trimethylamine, ethanolamine, diethanolamine and triethanolamine salts.

Anionic surfactants which are highly suitable for use as foaming agents are (1) acid esters or salts thereof of a polyadduct of 2 to 15 moles of ethylene oxide on 1 mole of fatty alcohol having 8 to 22 carbon atoms or on 1 mole of alkylphenol having 4 to 12 carbon atoms in the alkyl radical;

(2) alkyl sulfates whose alkyl chain contains 8 to 20 carbon atoms, for example lauryl sulfate;

(3) alkylphenylsulfonates having 8 to 18 carbon atoms in the alkyl radical; or (4) dialkylnaphthalenesulfonates having 3 to 5 carbon atoms per alkyl radical.

Said components (1) to (4) can be used as foaming agents either alone or mixed.

The nonionic surfactant is advantageously a nonionic alkylene oxide adduct of 1 to 100 moles of alkylene oxide, for example ethylene oxide and/or propylene oxide, on 1 mole of an aliphatic monoalcohol having at least 4 carbon atoms, a 3- to 6-hydric aliphatic alcohol, a phenol which can be substituted by alkyl or phenyl or a fatty acid having 8 to 22 carbon atoms.

Examples of nonionic surfactants are:

fatty alcohols having 8 to 22 carbon atoms, especially cetyl alcohol;

adducts of preferably 2 to 80 moles of alkylene oxides, in particular ethylene oxide, it being possible for individual ethylene oxide units to be replaced by substituted epoxides, such as styrene oxide and/or propylene oxide, on higher unsaturated or saturated monoalcohols, fatty acids, fatty amines or fatty amides having 8 to 22 carbon atoms or on phenylphenol or alkylphenols whose alkyl radicals have at least 4 carbon atoms;

alkylene oxide, in particular ethylene oxide and/or propylene oxide, condensation products (block polymers);

reaction products of a fatty acid having 8 to 22 carbon atoms and a primary or secondary amine having at least one hydroxy-lower-alkyl or lower-alkoxy-lower-alkyl group or alkylene oxide adducts of these hydroxyalkyl-containing reaction products, the reaction being effected in such a way that the molecular ratio between hydroxyalkylamine and fatty acid can be 1:1 and greater than 1, for example 1,1:1 to 2:1, and adducts of propylene oxide on a trihydric to hexahydric aliphatic alcohol of 3 to 6 carbon atoms, for example glycerol or pentaerythritol, the polypropylene oxide adducts having an average molecular weight of 250 to 1,800, preferably 400 to 900.

Nonionic surfactants which are highly suitable for use as foaming agents are:

(5) adducts of 2 to 15 moles of ethylene oxide on 1 mole of an aliphatic monoalcohol or fatty acid having 8 to 22 carbon atoms each or on 1 mole of alkylphenol having a total of 4 to 12 carbon atoms in the alkyl moiety, and (6) fatty acid dialkanolamides having 8 to 22 carbon atoms in the fatty acid radical and 2 to 6 carbon atoms in the alkanol moiety.

Other highly suitable nonionic surfactants are block polymers of the formula $$R-O-(CH_2CH_2-O)_{n1}-(\underset{Z_1}{CH}-\underset{Z_2}{CH}-O)_y-(CH_2CH_2O)_{n2}-H \quad (1)$$

or of the formula

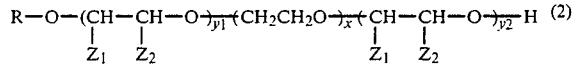

(2)

in which R is hydrogen, alkyl or alkenyl having at most 18 carbon atoms, preferably 8 to 16 carbon atoms, o-phenylphenyl or alkylphenyl having 4 to 12 carbon atoms in the alkyl moiety, one of $Z_1$ and $Z_2$ is hydrogen while the other is methyl, y is 1 to 75, preferably 3 to 50, x is 1 to 30, and the sum $n_1+n_2$ is 3 to 30, preferably 3 to 15, the sum $y_1+y_2$ is 2 to 30, preferably 4 to 20, and $n_2$ and $y_2$ can also be 0.

Preferred block polymers of the formula (1) are those in which R is alkyl or alkenyl of 4 to 18, preferably 8 to 16, carbon atoms, y is 1 to 15, preferably 3 to 15, $n_1$ is 3 to 15, and $n_2$ is 0.

Particularly advantageous block polymers are fatty alcohol polyglycol coethers, in particular adducts of 3 to 10 ethylene oxide and 3 to 10 moles of propylene oxide on aliphatic monoalcohols of 8 to 16 carbon atoms, preferably alkanols of 8 to 16 carbon atoms.

These block polymers are advantageously composed of 10 to 50 percent by weight of units derived from ethylene oxide and 50 to 90 percent by weight of units derived from propylene oxide and have a molecular weight of 250 to 6,000, in particular 350 to 3,000.

The nonionic surfactants used can also be siloxaneoxyalkylene copolymers. These polymers are reaction products of halogen-substituted organopolysiloxanes and alkali metal salts of polyoxyalkylene, for example polyethylene glycol or polypropylene glycol. Compounds of this type are described for example in European Patent Specification No. 30,919 or 49,832.

Preferred block polymers and siloxane-oxyalkylene copolymers which are used as foaming agents or foam-moderators advantageously have a cloud point of 15° to 70° C., preferably 25° to 50° C. The cloud point is determined for example according to DIN No. 53,917.

The foaming agents used according to the invention are preferably used in the form of mixtures of the above-mentioned anionic and/or nonionic surfactants.

In addition to the anionic and/or nonionic surfactants mentioned, the foam-forming mixtures can contain quaternary ammonium salts. These can be prepared for example by reacting aliphatic fatty amines whose alkyl or alkenyl radicals have 8 to 24 carbon atoms, for example dodecylamine, hexadecylamine, heptadecylamine, octadecylamine, tallow amine, behenylamine or oleylamine or diamines and triamines, for example dodecylpropylenediamine, octadecylethylenediamine and octadecyldiethylenetriamine, with 1 to 35 equivalents of an alkylene oxide, for example propylene oxide, but especially ethylene oxide or a mixture of propylene oxide and ethylene oxide, and optionally in addition with 1 to 2 equivalents of styrene oxide and subsequently reacting with customary quaternising agents, for example methyl halide, ethyl halide, benzyl halide, diethyl sulfate or especially dimethyl sulfate, halogenohydrins, or halogenocarboxamides, for example chloroacetamide.

It is also possible to use mixtures of these cationic assistants.

Compounds which have been found to be particularly suitable for use as cationic assistants are the products obtained on quaternising adducts of 2 to 35 moles of ethylene oxide and optionally in addition 1 mole of styrene oxide on alkylamines or alkenylamines having 12 to 24 carbon atoms or mixtures thereof with dimethyl sulfate, diethyl sulfate or $C_1$–$C_2$-alkyl halides, for example methyl chloride or methyl iodide.

Examples of preferred mixtures of foaming agents are combinations of components (1), (2), (3), (4), (5) and (6) and especially those of (A) alkylsulfonates having 8 to 10 carbon atoms and fatty alcohols having 12 to 22 carbon atoms or adducts of 1 to 4 moles of ethylene oxide on these fatty alcohols, (B) adducts of 2 to 12 moles of ethylene oxide on 1 mole of alkylphenol having 4 to 12 carbon atoms in the alkyl moiety, sodium salts of sulfuric acid esters of fatty alcohol/ethylene oxide adducts having 10 to 12 carbon atoms in the alcohol moiety and 2 to 4 ethylene oxide units, and fatty acid diethanolamides having 8 to 18 carbon atoms in the fatty acid radical, (C) adducts of 1 to 15 moles of ethylene oxide on 1 mole of fatty alcohol having 12 to 22 carbon atoms, fatty acid diethanolamides having 8 to 18 carbon atoms in the fatty acid radical, (D) sodium salts of sulfuric acid esters of fatty alcohol ethylene oxide adducts having 10 to 22 carbon atoms in the alcohol moiety and 2 to 4 ethylene oxide units, fatty acid diethanolamides having 8 to 18 carbon atoms in the fatty acid radical and if desired adducts of 1 to 4 moles of ethylene oxide on $C_{12}$–$C_{22}$ alcohols, (E) sodium salts of sulfuric acid esters of fatty alcohol ethylene oxide adducts having 10 to 22 carbon atoms in the alcohol moiety and 2 to 4 ethylene oxide units, fatty acid diethanolamides having 8 to 18 carbon atoms in the fatty acid radical, alkylbenzenesulfonates having 8 to 12 carbon atoms in the alkyl moiety and if desired in addition the disodium salt of 1-benzyl-2-$C_{17}$–$C_{18}$-alkylbenzimidazoledisulfonic acid, (F) a sulfuric acid ester or its salts of an adduct of 2 to 15 moles of ethylene oxide on 1 mole of aliphatic monoalcohol having 8 to 18 carbon atoms or in particular on 1 mole of an alkylphenol having 4 to 12 carbon atoms in the alkyl radical, and an adduct of 3 to 10 moles of ethylene oxide and 3 to 10 moles of propylene oxide on 1 mole of an aliphatic monoalcohol having 8 to 16 carbon atoms, or (G) a sulfuric acid ester or its salts (in particular diethanolamine salts) of an adduct of 2 to 15 moles of ethylene oxide on 1 mole of an aliphatic monoalcohol having 8 to 18 carbon atoms, a fatty acid diethanolamide having 8 to 18 carbon atoms in the fatty acid radical, a dialkylnaphthalenesulfonate having 3 to 5 carbon atoms per alkyl radical and if desired an adduct of 2 to 80 moles of ethylene oxide on 1 mole of fatty alcohol having 12 to 22 carbon atoms and/or an adduct, quaternised with dimethyl sulfate, of 1 mole of styrene oxide and 10 to 30 moles of ethylene oxide on a fatty amine having 12 to 22 carbon atoms.

The foam-forming mixtures can be prepared by simply stirring the components with water. If desired, the foaming agents can be added to the treatment liquors in the form of one or more mixtures. The individual mixtures can also serve as foam moderators, foam stabilisers or wetting agents.

The amounts in which the foaming agents are added to the treatment liquors, preferably in the form of mixtures, vary with the method of printing between 0.5 and 200 g, preferably between 1.5 and 150 g, per liter of treatment liquor to be foamed.

The dyes used in the process according to the invention are reactive dyes customarily used for dyeing or printing cellulose textile materials.

Reactive dyes are to be understood as meaning the customary dyes which enter a chemical bond with the cellulose, for example the Reactive Dyes mentioned on pages 3391–3560 in volume 3 of the 3rd edition (1971) of the Colour Index and on pages 6268–6345 in volume 6 of the revised 3rd edition (1975) of the Colour Index.

The amount of dye generally depends on the desired depth of shade and conveniently is between 0.1 and 300 g per liter of printing colour, advantageously 0.1 to 100 and preferably 5 to 60 g per liter of printing colour.

Since reactive dyes are used the preparations generally contain fixing alkalis. Examples of alkaline compounds which are used for fixing the reactive dyes are sodium carbonate, sodium bicarbonate, sodium hydroxide, disodium phosphate, trisodium phosphate, borax, aqueous ammonia and alkali donors, for example sodium trichloroacetate or sodium formate. The alkali used can also be a mixture of sodium silicate and a 25% aqueous sodium carbonate solution.

The pH of the alkali-containing printing colours is generally 7.5 to 13.2, preferably 8.5 to 11.5.

The process according to the invention is suitable for printing textiles which are made of or contain cellulose.

The cellulose material can be made of regenerated or in particular natural cellulose, for example staple viscose, filament viscose, hemp, linen, jute or preferably cotton, or of fibre blends, for example nylon/cotton or in particular polyester/cotton, in which the polyester portion can be simultaneously printed with disperse dyes.

The textile material can be used in any form, for example yarns, hanks, woven fabrics, knitted fabrics, felts, preferably in the form of textile sheetlike structures such as woven or knitted fabrics which wholly or partly consist of native, regenerated or modified cellulose.

The printing colours to be foamed are advantageously prepared by dissolving the dye and by adding the acrylamide polymer, the foaming agents and if necessary alkali. Depending on the dye used, the printing colours can contain further customary additives, for example electrolytes, glycerol, urea, oxidising agents, for example nitrobenzenesulfonate or sodium chlorate, sequestrants or, depending on the printing colour, wetting agents as well. The addition of thickeners is not necessary.

The foams can be produced on the commercially customary foaming apparatus, in a continuous manner if desired.

According to the invention, suitable degrees of foaming, i.e. volume ratios of unfoamed to foamed preparation, range from 1:2 to 1:100, preferably 1:4 to 1:20.

The foams used according to the invention are distinguished by high thickness, density and stability, i.e. by long use lives. The foams used according to the invention preferably have half-lives of 5 minutes to 24 hours, preferably 30 minutes to 6 hours. The bubble diameters in the foams measure about 1 to 100 $\mu$.

The foams can be evenly applied to the fibre material by all kinds of techniques. Examples of possible techniques are: sucking, roller-coating (on one or both sides), blowing, pressing or printing. The foamed colour can be applied with the machines customary in textile printing, for example roller or rotatory printing machines. Advantageously the foam is applied by means of a screen-printing machine, preferably within a sealed system. Systems of this type are described for example in German Offenlegungsschriften Nos. 3,034,802 and 3,034,803.

The foams are advantageously applied at a temperature of 10° to 90° C., generally at room temperature, i.e. at about 15° to 30° C. The foam is generally applied in an amount of 10 to 120, in particular 15 to 50, percent by weight on fibre.

The foam can be applied on a foam container to the face of the fabric via an application roller, preferably using an adjustable doctor blade. On contact with the fabric the foam is immediately dewatered. If desired, the application of foam can be repeated on the back of the fabric. In that case, there is no need for an intermediate drying operation between the application to the front and that to the back. It is also possible for different printing foams to be applied to the front and the back of the textile.

Preferably, the foam application according to the invention is effected by, first, foaming up the treatment liquor in a suitable apparatus within a sealed system, for example under pressure, and transporting the resulting foam by means of pipes to the application apparatus. The foam is then applied to the textile sheetlike structure, preferably through a sieve or a sievelike intermediate carrier, whereupon the foam is sucked into the cloth by mechanical pressing, squeezing or smoothing. The sieve or sievelike intermediate carrier can be a sheet of perforated metal, a mesh, a net, a wire fabric, a sieve drum or a sieve screen.

Said procedures have the effect of destroying the structure of the foam by bursting the foam bubbles, whereupon the foam dewaters and the textile material is uniformly wetted.

After the foam application and the watering of the foam the printed textile material is subjected to a heat-treatment in order to fix the applied dyes.

The thermal fixing can be carried out in the form of a hot-batch process or a thermosoling process or preferably as a steaming.

In the steaming process, the textile materials which have been printed with the coloured foam are subjected to a treatment at a temperature of 98° to 210° C., advantageously 100° to 180° C. and preferably 102° to 120° C. in a steamer with saturated or supersaturated steam, in order to fix the dyes.

In the hot-batch process, the cloth is left in the moist state at temperatures of advantageously 85° to 102° C. for, for example, 5 to 120 minutes. Before this batching stage the printed cloth can be preheated to 85° to 102° C. by means of an infrared treatment. The batching temperature is preferably 95° to 100° C.

In the so-called thermosoling process, the dyes are fixed at a temperature of 100° to 210° C., if desired after an intermediate drying stage. The thermosoling is preferably carried out at a temperature of 120° to 210° C., preferably 140 to 180° C., and after an intermediate drying at a printed cloth temperature of 80° to 120° C. Depending on the temperature, the thermosoling can take 20 seconds to 5 minutes, preferably 30 seconds to 4 minutes.

Following the colouring process, the coloured cellulose-containing textile material can be washed out in conventional manner in order to remove unfixed dye. For this purpose, the substrate is treated, for example, at between 40° C. and the boiling in a solution which contains soap or synthetic detergent. This can be followed by a treatment with a fixing agent in order to improve the wet fastness properties.

The process according to the invention produces level and deep prints which are disinguished by crispness, good handle and excellent appearance. Furthermore, the end-use properties of the coloured goods, for example light fastness, rub fastness and wet fastness properties, are not adversely affected by using the acrylamide polymer of the type defined.

In particular, by means of the foam application according to the invention it is possible to obtain prints with reactive dyes on cellulose-containing textiles without using the customary thickeners, for example alginates, cellulose derivatives, starch ethers or bean flour ethers such as carob bean flour ether, which are generally used in large amounts. According to the invention, prints of excellent crispness are obtained even in the presence of low amounts of the acrylamide polymers of the type defined.

In the following preparative methods and examples, the parts and percentages are by weight, unless otherwise stated.

The quantities in the case of the dyes relate to commercially available, i.e. diluent-containing, material and in the case of assistants to the pure substance. The five-digit colour index numbers (C.I.) refer to the 3rd edition of the Colour Index.

PREPARATIVE METHODS

Method 1:

A solution of 22.5 g of acrylamide, 2.5 g of an adduct of 52 moles of propylene oxide on 1 mole of glycerol and 0.04 g of potassium peroxodisulfate in 200 g of water is heated with stirring and passing over of nitrogen to 50° C. and is held at that temperature for 3 hours. A solution of 0.03 g of potassium peroxodisulfate in 40 g of water is then added dropwise in the course of 60 minutes, and the very viscous solution is diluted by adding 300 ml of water in the course of 30 minutes. The reaction mixture is then maintained at 50° C. for 5 hours, then has added to it 0.6 g of hydroquinone monomethyl ether and 0.12 g of sodium azide, and is cooled down to room temperature with stirring. The result is 565 g of a gel having a polymer content of 4.4%. This gel has a viscosity, measured at 25° C., of 112,957 mPas.

Method 2:

A solution of 71.25 g of acrylamide, 3.75 g of an adduct of propylene oxide and glycerol having an average molecular weight of 4,200 and 0.09 g of potassium peroxodisulfate in 600 g of water is heated with stirring and passing over of nitrogen to 50° C. and is maintained at 50° C. for 3 hours. The viscosity of the solution gradually increases. A solution of 0.06 g of potassium peroxodisulfate in 120 g of water is added dropwise in the course of 60 minutes. About 10 minutes after the start of the dropwise addition the solution becomes so viscous that it is necessary to add 600 g of water during the subsequent 20 minutes. When the dropwise addition of the potassium peroxodisulfate solution is complete, the increasingly viscous solution is held at 50° C. for a further 5 hours and is diluted with an additional 400 g of water added a little at a time. 1.7 g of hydroquinone monomethyl ether are added, the mixture is cooled with stirring to room temperature and the result is 1,794 g of a free-flowing gel having a polymer content of 4.3%. This gel has a viscosity, measured at 25° C., of 64,202 mPas.

Method 3:

A solution of 71.25 g of acrylamide, 3.75 g of an adduct of propylene oxide and pentaerythritol having an average molecular weight of 3,350 and 0.09 g of potassium peroxodisulfate in 600 g of water is heated with stirring and passing over of nitrogen to 50° C. and is maintained at 50° C. for 3 hours. The viscosity of the solution gradually increases. A solution of 0.06 g of potassium peroxodisulfate in 120 g of water is then added dropwise in the course of 60 minutes. About 30 minutes after the dropwise addition has ended the viscosity of the solution increases. For that reason, 600 g of water are added during the subsequent 20 minutes. The increasingly viscous solution is then maintained at 50° C. for a further 4 hours, is thereafter diluted with an additional 400 g of water, has 3.4 g of triethanolamine added and is cooled down to room temperature with stirring, the result being 1,793 g of a still fluent gel having a solids content of 4.0%. This gel has a viscosity, measured at 25° C., of 75,300 mPas.

Method 4:

A solution of 17.8 g of acrylamide, 0.94 g of an adduct of 70 moles of propylene oxide and 6 moles of ethylene oxide on 1 mole of glycerol and 0.025 g of potassium peroxodisulfate in 250 g of water is heated with stirring and passing over of nitrogen to 50° C. and is maintained at that temperature for 3 hours. The temperature of the solution is raised to 60°–63° C. in the course of 20 minutes until the viscosity shows an appreciable increase, and is then cooled down to 55° C. The increasingly viscous solution is maintained at 55° C. for 5 hours. The viscous solution then has added to it a solution of 0.45 g of chloroacetamide and 0.45 g of hydroquinone monomethyl ether in 177 g of water, the result being 446 g of a gel having a graft polymer content of 4.2%. This gel has a viscosity, measured at 25° C., of 96,750 mPas.

Method 5:

Replacing the indicated adduct in method 4 by a further adduct of 53 moles of propylene oxide on 1 mole of trimethylolpropane affords 446 g of a gel having a graft polymer content of 4.2%. This gel has a viscosity, measured at 25° C., of 19500 mPas.

Method 6:

A solution of 17.24 g of acrylamide, 4.31 g of an adduct of 70 moles of propylene oxide on 1 mole of glycerol and 0.035 g of potassium peroxodisulfate in 200 g of water is heated with stirring and passing over of nitrogen to 50° C. and is maintained at that temperature for 4 hours. The increasingly viscous solution is then heated at 55° C. for 5 hours. The gel has added to it a solution of 0.4 g of chloroacetamide and 0.4 g of hydroquinone monomethyl ether in 291 g of water, the result being 513 g of a gel having a polymer content of 4.2%. This gel has a viscosity, measured at 25° C., of 25,750 mPas.

Method 7:

A mixture of 15.1 g of acrylamide, 6.5 g of an adduct of 70 moles of propylene oxide on 1 mole of glycerol and 0.025 g of potassium peroxodisulfate in 200 g of water is heated with stirring and passing over of nitrogen to 50° C. and is maintained at that temperature for 3 hours. The increasingly viscous solution is then heated at 55° C. for 5 hours. The gel has added to it a solution of 0.4 g of chloroacetamide and 0.4 g of hydroquinone monomethyl ether in 291 g of water, the result being 512 g of a gel having a polymer content of 4.2%. This gel has a viscosity, measured at 25° C., of 16,300 mPas.

Method 8:

A mixture of 13 g of acrylamide, 8.7 g of an adduct of 70 moles of propylene oxide on 1 molef glycerol and 0.015 g of potassium peroxodisulfate in 150 g of water is heated with stirring and passing over of nitrogen to 50° C. and is maintained at that temperature for 4 hours. The increasingly viscous solution is then heated at 65° C. for 2 hours and a further 3 hours at 60° C. The gel has added to it a solution of 0.4 g of chloroacetamide and 0.4 g of hydroquinone monomethyl ether in 347 g of water, the result being 519 g of a gel having a polymer content of 4.2%. This gel has a viscosity, measured at 25° C., of 15,582 mPas.

EXAMPLE 1

A printing colour is prepared to contain the following additives in 1 liter of water: 10 g of a dye of the formula

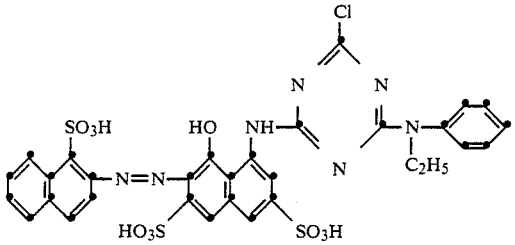

(11)

50 g of an aqueous mixture which contains 7.5 g of an adduct of 2 moles of ethylene oxide on 1 mole of cetyl alcohol and 0.025 g of sodium laurylsulfate,
2 g of the graft polymer prepared in method 2,
10 g of the sodium salt of m-nitrobenzenesulfonic acid,
60 g of a 25% aqueous sodium carbonate solution and
150 g of urea.

The printing colour is then foamed up within a sealed system using a foaming apparatus. The degree of foaming is 1:8. The foam half-life is 90 minutes.

This foam is forced through pipes via a sieve screen onto a cotton fabric under a pressure of 0.40 bar. The printed fabric is then steamed at 102° C. for 8 minutes and is then soaped off and dried in a conventional manner.

The result is a deep, level and crisp red print having excellent handle and good end-use fastness properties.

Similar, high-quality prints are obtained on using, in place of the graft polymer prepared according to method 2, equal amounts of the graft polymers prepared according to methods 1 and 3 to 8 and polyacrylamide in the form of a 4% aqueous solution having a viscosity, measured at 25° C., of 28,000 cps.

EXAMPLE 2

A printing colour is prepared to contain the following additives in 1 liter of water:

20 g of a dye of the formula

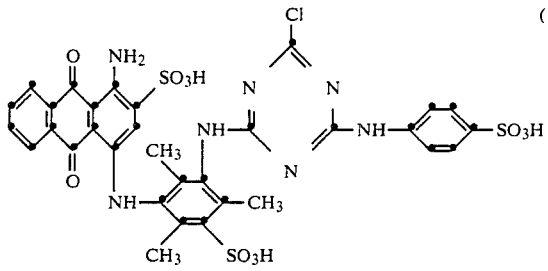

(12)

1.8 g of a mixture of the di-(β-hydroxyethyl)-amine salt of the acid sulfuric acid ester of the adduct of 3 moles of ethylene oxide on 1 mole of lauryl alcohol and cocoacid-N-di-β-hydroxyethylamide (1:1),
0.7 g of a mixture of 13 parts of an adduct, quaternised with dimethyl sulfate, of 1 mole of styrene oxide and 15 moles of ethylene oxide on 1 mole of oleyl amine, 13 parts of dibutylnaphthalenesulfonic acid and 7 parts of the adduct of 80 moles of ethylene oxide on 1 mole of oleyl alcohol,
2 g of the graft polymer prepared in method 2,
10 g of the sodium salt of m-nitrobenzenesulfonic acid and
70 g of 25% aqueous sodium carbonate solution.

The printing colour is then foamed up within a sealed system using a foaming apparatus. The degree of foaming is 1:40. The foam half-life is 2 hours.

This foam is forced through pipes via a sieve screen onto a cotton fabric under a pressure of 0.40 bar. The printed fabric is then dried, is steamed at 100° C. for 8 minutes and is then soaped off and dried again in a conventional manner.

The result is a deep, level and crisp red print having excellent handle and good end-use fastness properties.

EXAMPLE 3

A printing colour is prepared to contain the following additives in 1 liter of water:

75 g of a dye of the formula

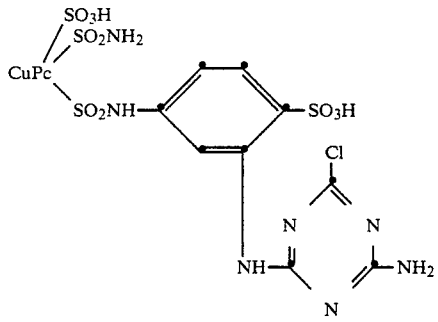

(13)

100 g of an aqueous mixture which contains 15.0 g of an adduct of 2 moles of ethylene oxide on 1 mole of cetyl alcohol and 0.05 g of sodium laurylsulfate,
10 g of the graft polymer prepared in method 4,
10 g of the sodium salt of m-nitrobenzenesulfonic acid,
80 g of a 25% aqueous sodium carbonate solution and
100 g of urea.

The printing colour is then foamed up within a sealed system using a foaming apparatus. The degree of foaming is 1:8. The foam half-life is <2 hours.

This foam is forced through pipes via sieve screen onto a cotton fabric under a pressure of 0.20 bar. The printed fabric is then dried, is steamed at 140° C. for 4 minutes and is then soaped off and dried again in a conventional manner.

The result is a level brilliant turquoise print having good fastness properties.

Similar, high-quality prints are obtained on using in place of the graft polymer prepared in method 4 an equal amount of the graft polymers prepared in methods 1 to 3 and 5 to 8.

EXAMPLE 4

A printing colour is prepared to contain the following additives in 1 liter of water:

10 g of a dye of the formula

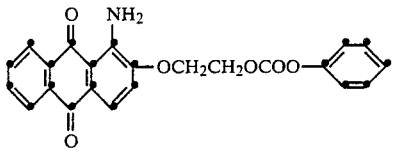

(14)

10 g of the dye of the formula (11), 150 g of an aqueous mixture which contains 22.5 g of an adduct of 2 moles of ethylene oxide on 1 mole of cetyl alcohol and 0.075 g of sodium laurylsulfate, 20 g of the graft polymer prepared in method 2, 10 g of the sodium salt of m-nitrobenzenesulfonic acid, 8 g of sodium bicarbonate and 50 g of urea.

The printing colour is then foamed up in a suitable foaming apparatus, the degree of foaming being 1:6. The foam is printed through a screen with a doctor blade onto a blend fabric of cotton/polyester (33/67). The printed fabric is then dried, steamed at 180° C. for 8 minutes and is then rinsed, soaped off and dried in a conventional manner.

The result is a level, brilliant red print having good fastness properties.

EXAMPLE 5

A printing colour is prepared to contain the following additives in 1 liter of water:

100 g of the reactive dye Reactive Black 1 C.I. 17,916, 100 g of an aqueous mixture which contains 15.0 g of an adduct of 2 moles of ethylene oxide on 1 mole of cetyl alcohol and 0.05 g of sodium laurylsulfate, 10 g of the graft polymer prepared in method 2, 10 g of the sodium salt of m-nitrobenzenesulfonic acid, 170 g of a 25% aqueous sodium carbonate solution and 200 g of urea.

The printing colour is then foamed up within a sealed system using a foaming apparatus. The degree of foaming is 1:7. The foam half-life is <2 hours.

This foam is forced through pipes via a sieve screen onto a cotton fabric under a pressure of 0.20 bar. The printed fabric is then dried, heat-treated at 150° C. for minutes, and is then, as usual, rinsed and dried again.

The result is a level, grey print having good fastness properties.

We claim:

1. A process for printing cellulose-containing textile material with a reactive dye which process comprises printing the textile material with a foamed aqueous preparation containing at least one reactive dye, at least one foaming agent and a homopolymer or co-polymer of acrylamide or methacrylamide; or a graft polymer obtained from an adduct of an alkylene oxide on an at least trihydric aliphatic alcohol having 3 to 10 carbon atoms and acrylamide or methacrylamide, and subsequently fixing the dye by a heat treatment.

2. A process according to claim 1, wherein the preparation contains the polymer in an amount of 0.1 to 20 g in the form of an aqueous solution per liter of unfoamed preparation.

3. A process according to claim 1, wherein the preparation contains the polymer in an amount of 0.5 to 10 g, in the form of a 2 to 10% aqueous solution per liter of unfoamed preparation.

4. A process according to claim 1, wherein the preparation contains, a graft polymer obtained by graft polymerization of acrylamide or methacrylamide onto an adduct of 4 to 100 moles of propylene oxide on a trihydric to hexahydric alkanol having 3 to 6 carbon atoms.

5. A process according to claim 1, wherein the graft polymer contains 2.5 to 50% by weight of the adduct and 50 to 97.5% by weight of the grafted-on acrylamide or methacrylamide, based on the graft polymer.

6. A process according to claim 5 wherein the graft polymer contains 2.5 to 30% by weight of the adduct and 70 to 97.5% by weight of the grafted-on acrylamide or methacrylamide, based on the graft polymer.

7. A process according to claim 1, wherein the graft polymer has been prepared from acrylamide and an adduct of 40 to 80 moles of propylene oxide on 1 mole of glycerol.

8. A process according to claim 7, wherein the graft polymer contains 4 to 20% by weight of the adduct of 40 to 80 moles of propylene oxide on 1 mole of glycerol and 80 to 96% by weight of grafted-on acrylamide, based on the graft polymer.

9. A process according to claim 1, wherein the preparation contains as foaming agent a mixture of alkylsulfonates having 8 to 10 carbon atoms and fatty alcohols having 12–22 carbon atoms or adducts of 1 to 4 moles of ethylene oxide on 1 mole of these fatty alcohols.

10. A process according to claim 1, wherein the preparation contains as foaming agent a mixture of adducts of 2 to 12 moles of ethylene oxide on 1 mole of alkylphenol having 4 to 12 carbon atoms in the alkyl moiety, sodium salts of sulfuric acid esters of fatty alcohol/ethylene oxide adducts having 10 to 12 carbon atoms in the alcohol moiety and 2 to 4 ethylene oxide units and fatty acid diethanolamides having 8 to 18 carbon atoms in the fatty acid radical.

11. A process according to claim 1, wherein the preparation contains as foaming agent a mixture of adducts of 1 to 15 moles of ethylene oxide on 1 mole of fatty alcohol having 12 to 22 carbon atoms, and fatty acid diethanolamides having 8 to 18 carbon atoms in the fatty acid radical.

12. A process according to claim 1, wherein the preparation contains as foaming agent a mixture of sodium salts of sulfuric acid esters of fatty alcohol/ethylene oxide adducts having 10 to 22 carbon atoms in the alcohol moiety and 2 to 4 ethylene oxide units and fatty acid diethanolamides having 8 to 18 carbon atoms in the fatty acid radical.

13. A process according to claim 1, wherein the preparation contains as foaming agent a mixture of sodium salts of sulfuric acid esters of fatty alcohol/ethylene oxide adducts having 10 to 22 carbon atoms in the alcohol moiety and 2 to 4 ethylene oxide units, fatty acid diethanolamides having 8 to 18 carbon atoms in the fatty acid radical, and alkylbenzenesulfonates having 8 to 12 carbon atoms in the alkyl moiety.

14. A process according to claim 1, wherein the preparation contains as foaming agent a mixture of a sulfuric acid ester or its salts of an adduct of 2 to 15 moles of ethylene oxide on 1 mole of an aliphatic monoalcohol having 8 to 18 carbon atoms or 1 mole of an alkylphenol having 4 to 12 carbon atoms in the alkyl radical and an adduct of 3 to 10 moles of ethylene oxide and 3 to 10 moles of propylene oxide on an aliphatic monoalcohol of 8 to 16 carbon atoms.

15. A process according to claim 1, wherein the preparation contains as foaming agent a mixture of a sulfuric acid ester or its salts of an adduct of 2 to 15 moles of ethylene oxide on 1 mole of an aliphatic monoalcohol having 8 to 18 carbon atoms, a fatty acid diethanolamide having 8 to 18 carbon atoms in the fatty acid radical and a dialkylnaphthalenesulfonate having 3 to 5 carbon atoms per alkyl radical.

16. A process according to claim 1, wherein the preparation contains as foaming agent a mixture of a sulfuric acid ester or its salts of an adduct of 2 to 15 moles of ethylene oxide on 1 mole of an aliphatic monoalcohol having 8 to 18 carbon atoms, a fatty acid diethanolamide having 8 to 18 carbon atoms in the fatty acid radical, a dialkylnaphthalenesulfonate having 3 to 5 carbon atoms per alkyl radical, an adduct of 2 to 80 moles of ethylene oxide on 1 mole of fatty alcohol having 12 to 22 carbon atoms and an adduct, quaternised with dimethyl sulfate, of 1 mole of styrene oxide and 10 to 30 moles of ethylene oxide on 1 mole of a fatty amine having 12 to 22 carbon atoms.

17. A process according to claim 1, wherein the preparation additionally contains fixing alkalis.

18. A process according to claim 1, wherein printing takes place on a screen-printing machine.

19. A process according to claim 18, wherein the preparation is applied to a sieve or sievelike intermediate carrier and is forced through the sieve or the sievelike intermediate carrier.

20. A process according to claim 1, wherein the heat treatment is carried out steaming.

21. A process according to claim 1, wherein the heat treatment is carried out by thermosoling.

22. An aqueous preparation for printing cellulose-containing textile material with a reactive dye which contains at least one reactive dye, at least one foaming agent and a homopolymer or copolymer of acrylamide or methacrylamide or a graft polymer obtained from an adduct of an alkylene oxide on an at least trihydric aliphatic alcohol having 3 to 10 carbon atoms and acrylamide or methacrylamide.

23. An aqueous preparation according to claim 22 in foamed form.

* * * * *